US012139690B2

(12) United States Patent
Hollmann et al.

(10) Patent No.: US 12,139,690 B2
(45) Date of Patent: Nov. 12, 2024

(54) SIMPLIFIED METHOD FOR PRETREATING METAL SUBSTRATES FOR COLD FORMING AND REACTIVE LUBRICANT THEREFOR

(71) Applicant: CHEMETALL GMBH, Frankfurt (DE)

(72) Inventors: Frank Hollmann, Frankfurt am Main (DE); Benjamin Guettler, Frankfurt am Main (DE); Yinfeng Shi, Frankfurt am Main (DE)

(73) Assignee: CHEMETALL GMBH, Frankfurt (DE)

( * ) Notice: Subject to any disclaimer, the term of this patent is extended or adjusted under 35 U.S.C. 154(b) by 505 days.

(21) Appl. No.: 17/428,939

(22) PCT Filed: Feb. 7, 2020

(86) PCT No.: PCT/EP2020/053089
§ 371 (c)(1),
(2) Date: Aug. 5, 2021

(87) PCT Pub. No.: WO2020/165035
PCT Pub. Date: Aug. 20, 2020

(65) Prior Publication Data

US 2022/0119730 A1 Apr. 21, 2022

(30) Foreign Application Priority Data

Feb. 14, 2019 (EP) ..... 19157198

(51) Int. Cl.
*C10M 173/00* (2006.01)
*C23G 1/02* (2006.01)

(52) U.S. Cl.
CPC ..... *C10M 173/00* (2013.01); *C23G 1/02* (2013.01); *C10M 2207/123* (2013.01)

(58) Field of Classification Search
CPC .. C10M 173/00; C10M 2207/123; C23G 1/02
See application file for complete search history.

(56) References Cited

U.S. PATENT DOCUMENTS

| | | | | |
|---|---|---|---|---|
| 2,850,417 | A | 9/1958 | Jenkins et al. | |
| 10,392,705 | B2 | 8/2019 | Guttler et al. | |
| 2010/0062200 | A1* | 3/2010 | Domes | B05D 3/02 428/35.8 |
| 2013/0177768 | A1 | 7/2013 | Kruger et al. | |
| 2016/0265116 | A1* | 9/2016 | Güttler | C10M 173/02 |

FOREIGN PATENT DOCUMENTS

| | | | | |
|---|---|---|---|---|
| CN | 1777699 | A | 5/2006 | |
| CN | 102257178 | A | 11/2011 | |
| CN | 103314136 | A | 9/2013 | |
| DE | 1196467 | B | 7/1965 | |
| DE | 2125503 | A1 | 12/1972 | |
| DE | 2102295 | B2 | 8/1976 | |
| EP | 0232929 | A1 * | 1/1987 | C23C 22/46 |
| EP | 0233503 | A1 | 8/1987 | |
| EP | 3290544 | A1 * | 3/2018 | C10M 113/10 |
| GB | 1371981 | A | 10/1974 | |
| JP | S545847 | A | 1/1979 | |
| JP | S5672090 | A | 6/1981 | |
| WO | 9416119 | A1 | 7/1994 | |
| WO | 2015055756 | A1 | 4/2015 | |

OTHER PUBLICATIONS

English-language machine translation of EP 0232929 A1 (Year: 1987).*
International Search Report of corresponding PCT/EP2020/053089 mailed Apr. 15, 3 Pages.
European Search Report for EP Patent Application No. 19157198.3, Issued on Aug. 13, 2019, 6 pages.

* cited by examiner

*Primary Examiner* — James C Goloboy
(74) *Attorney, Agent, or Firm* — Armstrong Teasdale LLP

(57) ABSTRACT

Described herein is a simplified process for a pretreatment of metallic substrates for cold forming. Also described herein are a corresponding reactive lubricant, a metallic substrate which has been pretreated by the process, and a method of using the pretreated metallic substrate.

18 Claims, No Drawings

SIMPLIFIED METHOD FOR PRETREATING METAL SUBSTRATES FOR COLD FORMING AND REACTIVE LUBRICANT THEREFOR

CROSS-REFERENCE TO RELATED APPLICATIONS

This application is a U.S. National Phase Application of International Patent Application No. PCT/EP2020/053089, filed Feb. 7, 2020, which claims priority to European Patent Application No. 19157198.3, filed Feb. 14, 2019, the entire contents of which are hereby incorporated by reference herein.

FIELD OF INVENTION

The present invention relates to a simplified process for the pretreatment of metallic substrates for cold forming, to a corresponding reactive lubricant and to a metallic substrate which has been pretreated by the process and the use thereof.

BACKGROUND

Cold forming takes place at temperatures below the recrystallization temperature of the shaped body to be formed, usually at temperatures of up to about 450° C. Heating can occur solely by the frictional forces acting between the coated metallic shaped body blank and the tool during forming and by internal frictional forces due to material flow, but optionally also by preheating of the shaped bodies to be formed.

However, the temperature of the shaped bodies to be formed is usually initially ambient temperature, i.e. from about 10 to 32° C. However, if the shaped bodies to be formed are heated beforehand to temperatures in the range from, for example, 650 to 850° C., from 850 to 1250° C. or from 650 to 1250° C., the forming process is referred to as semihot forming or forging. In addition, elevated to high pressures usually occur during cold forming, e.g. in the case of steel in the range from 200 MPa to 1 GPa and sometimes even up to 2 GPa.

As shaped bodies to be formed, use is mostly made of strips, sheets, slugs, wires, wire bundles, shaped parts having a complicated shape, sleeves, profiles such as hollow or solid profiles, tubes, round blanks, disks, rods, bars or cylinders. The shaped bodies can in principle consist of any metallic material. The shaped body usually consists essentially of steel.

The cold forming operation comprises first and foremost drawing (tensile forming), spinning, ironing (forming to final dimensions) and/or deep drawing, thread rolling and/or thread striking, pressing such as cold flow molding (pressure forming) and/or cold upset forging.

While unreactive forming oils are usually utilized for cold forming of metallic shaped bodies at very low degrees of deformation and correspondingly low forces, in the case of higher degrees of deformation use is generally made of at least one coating as separation layer between shaped body and tool in order to avoid cold welding together of shaped body and tool. In the latter case, it is usual to provide the shaped bodies with at least one coating of a lubricant or with a lubricant composition in order to reduce the frictional resistance between the shaped body surface and the forming tool.

As separation layer, a highly crystalline coating is usually applied in a phosphoric acid solution in the presence of zinc salts; this coating does not melt at the prevailing temperatures, is chemically and physically attached (e.g. by chemisorption) to the metallic substrate and prevents cold welding because it serves as separation between tool and substrate during forming.

The lubricant composition employed on this separation layer can be of a great variety of types. The lubricant layer is preferably produced using a lubricant composition comprising soap, oil and/or organic polymer and/or copolymer.

The (water-based) lubricant compositions mentioned have an alkaline pH, while conventional baths for application of the separation layer have an acidic pH. In order to prolong the life of the baths, it is absolutely necessary to carry out rinsing between the two treatment operations and optionally remove excess acid by means of a suitable neutralizing agent. This results in a customary process sequence which can be made up as follows:

1) Cleaning (and rinsing),
2) Pickling (and rinsing),
3) Activation,
4) Conversion treatment with zinc phosphate,
5) Rinsing/neutralization
6) Lubrication
7) Optionally drying.

In step 1, all types of residues which can, for example, originate from the production of a fresh steel substrate are removed by means of strong alkaline cleaners at very high temperatures.

Step 2 comprises acid pickling of the surface including the removal of scale and rust. Depending on the type of acid used, the temperature can be in the range from ambient temperature to 60° C.

A classical phosphating process generally requires activation for adapting the size of the phosphate crystals. This step 3 is preferably carried out using water-based seed crystal solutions at from room temperature to 55° C.

In step 4, the conversion treatment is then carried out by means of an acidic, water-based zinc phosphate solution. The subsequent step 5 comprises a rinsing step followed by an optional neutralization.

Step 6 is the lubrication. Depending on the lubricant, this can be carried out in the presence of water-based polymers at from 55 to 60° C., water-based soaps at from 70 to 85° C. or water-based salt carrier crystals at above 70° C.

In the last step 7, forced drying is optionally carried out. This is sometimes necessary in the case of water-based lubricants since the treated bodies to be formed are in some cases tightly packed, e.g. wire bundles, in order to avoid water-based residues.

The search for ideal process efficiency has driven the cold forming industry in the direction of new technologies which require fewer treatment steps.

A simplification of steps 3 and 4 is described in WO 2015/055756 A1. Here, step 3 can be dispensed with as a result of the use of a phosphate-free conversion coating in step 4. Since the bath composition in step 4 is also simpler than in the case of zinc phosphating, the process has fewer control parameters, which makes it simpler to operate.

Attempts have already been made in the prior art to apply conversion layer (step 4) and lubricant layer (step 6) in one treatment operation. Thus, DE 2102295 B2 describes a reactive lubricating oil in the case of which an iron-containing phosphate layer is formed on the surface. However, this composition comprises less than 20% by weight of water; it thus has an oil-comprising main phase and can therefore not be referred to as water-based.

The typical application of lubricants takes place from open treatment baths in the cold forming industry. Oil-based systems lead to a higher VOC pollution (VOC=volatile organic compounds) since not inconsiderable amounts of oil can vaporize during the treatment. In addition, oil-based systems suffer from a problem in respect of occupational hygiene since they are combustible and at flash points of >150° C. have to be classified as hazardous materials. Water-based, i.e. emulsified, systems on the other hand usually suffer from no problems in respect of the fire load due to the water content, which is more than 35% by weight. Likewise, the VOC pollution is lower since the maximum temperature of the system is limited by the boiling point of water.

It was firstly therefore an object of the present invention to provide a water-based pretreatment process for cold forming, in which as few as possible treatment steps are required.

DESCRIPTION

As has surprisingly been found, it is possible to combine the step of conversion treatment (step 4) and of lubrication (step 6) into one step and accordingly omit the neutralization in between (step 5):

1) Cleaning (and rinsing),

2) Pickling (and rinsing) and

3) Combination of conversion treatment and lubrication.

In order to apply a highly crystalline conversion layer and a lubricant layer in combination in a water-based treatment operation, some difficulties had to be overcome. Thus, lubricants mostly have a strongly alkaline pH, while acidic corrosion is critical for the deposition of conversion layers.

Secondly, it was an object of the present invention to provide a pretreatment process for cold forming, in which the combined conversion and lubricant layer applied in step 3 has such a high layer weight and also such strong adhesion to the metal substrate that it is still present in a sufficient amount even after the forming operation, i.e. that it is not removed during the forming operation to such an extent that effective separation of the tool from the workplece and effective reduction of the coefficient of friction no longer takes place.

To ensure that the combined conversion and lubricant layer applied in step 3 is still present in a sufficient amount after the forming operation, it has in the present case been found to be necessary for said combined layer to be, like a pure crystalline, for example oxalate-based, conversion layer, both chemically bound, i.e. in the form of chemical bonds between crystals and surface, and physically bound, i.e. by adsorption, to the surface of the metallic substrate, rather than purely physically as is the case for the unreactive lubricants which are obtainable.

The above object has been achieved by a process according to the invention for the pretreatment of metallic substrates for cold forming, in which a metallic substrate to be formed is successively 1) preferably mechanically or chemically cleaned and subsequently rinsed, 2) preferably pickled and subsequently rinsed, 3) brought into contact with a water-based, acidic, reactive lubricant comprising a) oxalic acid, b) at least one accelerator which comprises nitroguanidine and/or at least one iron(III) source and c) at least one film former, at least one wax and/or at least one emulsified lubricating oil, and 4) is optionally dried, where the at least one film former is selected from the group consisting of homopolymers and copolymers of ethylene, propylene, styrene, (meth)acrylic acid, (meth)acrylate, vinylamine, vinylformamide, vinylpyrrolidone, vinylcaprolactam, vinyl acetate, vinylimidazole and/or epoxide and salts thereof and also polyurethanes, polyamides, polyethyleneimines, polyamines and salts thereof, where the at least one wax is selected from the group consisting of nonionic waxes and cationically stabilized waxes and where the at least one emulsified lubricating oil is selected from the group consisting of synthetic oils, mineral oils, vegetable oils and animal oils.

Since the application of lubricants in the cold forming industry is always carried out in dipping baths, there is usually, for safety reasons, the requirement that such lubricant compositions are not combustible, i.e. have a flash point of >150° C., and volatile organic compounds (VOC) are therefore largely avoided.

The water-based combined treatment operation in step 3 is therefore advantageously largely VOC-free, i.e. no VOCs such as volatile oils are added to the reactive lubricant in step 3.

DEFINITIONS

When it is in the present text stated that the metallic substrate to be formed is "successively" subjected to the treatment steps indicated, this does not rule out the possibility of one or more further treatment steps, e.g. further rinsing steps, being carried out before, between and/or after the treatment steps indicated. However, in a preferred embodiment no further treatment steps taking place before cold forming are carried out.

For the present purposes, "water-based" means that the corresponding composition, in particular the acidic, reactive lubricant, consists to an extent of more than 35% by weight of water.

A "reactive lubricant" is, for the purposes of the present invention, a lubricant which reacts with the metallic substrate and thus forms a combined conversion and lubricant layer on this substrate.

For the purposes of the present invention. "oxalic acid" also includes the singly or doubly deprotonated form of oxalic acid.

For the purposes of the present invention, an "iron(III) source" is preferably a water-soluble iron(III) salt such as iron(III) nitrate. However, a water-soluble iron(II) salt in combination with an oxidate suitable for producing iron(III) ions is also conceivable as iron(III) source.

A "film former" is for the present purposes a homopolymer or copolymer in which the individual polymer chains are physically crosslinked and which has viscoelastic properties.

"(meth)acrylic acid" is for the present purposes methacrylic acid and/or acrylic acid, while "(meth)acrylate" is correspondingly methacrylate and/or acrylate.

For the purposes of the present invention, a "wax" is to be understood as a material which at 20° C. is kneadable, is solid to brittle and hard, has a coarse to fine crystalline structure, in terms of color is translucent to opaque but is not vitreous, melts without decomposition at above 40° C., is a mobile liquid (low-viscosity) a little above the melting point, has a strongly temperature-dependent consistency and solubility and is polishable under gentle pressure. If more than one of the abovementioned properties is not satisfied, the material is accordingly not a wax. The wax is, for the purposes of the present invention, preferably emulsified in aqueous solution by means of nonionic and/or cationic substances.

For the present purposes, a "nonionic wax" can also be, in particular, a wax which is stabilized by nonionic groups or by nonionic substances such as surfactants, more preferably by nonionic substances, in particular by nonionic surfactants, in an acidic medium, so that the wax is present in the form of a wax emulsion.

A "cationically stabilized wax" is, for the present purposes, a wax which is stabilized by cationic groups or by cationic substances such as surfactants, more preferably by cationic substances, in particular by cationic surfactants, in an acid medium, so that the wax is present in the form of a wax emulsion.

A "combined conversion and lubricant layer" is, for the purposes of the present invention, firstly a chemically homogeneous layer which combines the properties of a conversion layer and a lubricant layer in itself. However, it can also be a coating which has chemically heterogeneous regions, i.e. regions having a conversion layer and regions having a lubricant layer, above one another or next to one another.

When the expression "calculated as X", where X is in each case a particular, specifically indicated chemical compound, is used in the present text in connection with concentrations by weight (g/l or % by weight) this has the following meaning: When an alternative chemical compound (not X) is used, it should be used in a molar concentration as is calculated for X from the in each case specifically indicated concentration by weight (g/l or % by weight) taking into account its molar mass.

The metallic substrate to be formed can be, for example, a strip (also known as a "coil" to a person skilled in the art), a sheet, an, optionally predrawn, wire, a wire bundle, a shaped part having a complicated shape, a sleeve, a profile such as a hollow or solid profile, a tube, a round blank, a disk, a rod, a bar, a cylinder, a slug, a blank or a semifinished part. To a person skilled in the art, a slug is a disk or a section of a wire, of a wire bundle or of a bar.

The metallic substrate to be formed can in principle consist of any metallic material. It preferably consists predominantly, i.e. to an extent of more than 50 mol %, of a metal or a metal alloy selected from the group consisting of iron, steel, aluminum, aluminum alloys, copper, copper alloys, magnesium, magnesium alloys, titanium and titanium alloys. The metallic substrate to be formed more preferably consists of iron materials such as steel, alloyed steels or stainless steels.

In the step 1 which is preferably carried out in the process of the invention, the metallic substrate is firstly mechanically or chemically cleaned. Chemical cleaning is preferably carried out by dipping into a water-based, alkaline cleaning bath for from 10 to 30 minutes at from 70 to 90° C., while mechanical cleaning is preferably carried out by means of dry or wet scale removal or particle blasting.

The metallic substrate is subsequently rinsed. Rinsing is preferably carried out by means of deionized water or mains water.

In the step 2 which is likewise preferably carried out, the metallic substrate is then pickled. Pickling is preferably carried out by dipping into a water-based, acidic pickling bath for from a number of seconds to 30 minutes at up to about 70° C. Pickling is usually carried out in, optionally inhibited, hydrochloric acid, sulfuric acid or phosphoric acid. It can be carried out in a bath but also in a cascade of baths.

The metallic substrate is subsequently rinsed. Rinsing here is preferably carried out by means of deionized water or mains water.

As component a), the reactive lubricant in step 3 of the process of the invention preferably comprises from 2 to 500 g/l, particularly preferably from 5 to 100 and very particularly preferably from 10 to 50 g/l of oxalic acid, in each case calculated as oxalic acid dihydrate.

The oxalic acid is preferably added to the reactive lubricant as oxalic acid dihydrate, which is cheaper and less hygroscopic.

The reactive lubricant in step 3 comprises at least one accelerator comprising nitroguanidine and/or at least one iron(III) source as component b). Here, the content of nitroguanidine is preferably in the range from 0.01 to 20 g/l, particularly preferably from 0.5 to 10 g/l and very particularly preferably from 1.0 to 5 g/l, while the content of iron(III) is preferably in the range from 0.0004 to 2 g/l, particularly preferably from 0.04 to 2 g/l and very particularly preferably from 0.4 to 2 g/l, calculated as iron(III) nitrate.

In a preferred embodiment, the reactive lubricant therefore comprises a) from 2 to 500 g/l, preferably from 10 to 50 g/l, of oxalic acid, in each case calculated as oxalic acid dihydrate, and b) from 0.01 to 20 g/l, preferably from 1.0 to 5 g/l, of nitroguanidine and/or from 0.0004 to 2 g/l, preferably from 0.4 to 2 g/l of iron(III), calculated as iron(III) nitrate, plus the component c).

The reactive lubricant preferably comprises at least one accelerator comprising at least one iron(III) source as component b). The presence of an iron(III) source has the advantage that relatively fine layers, i.e. layers having relatively small crystals (diameter about 3-5 μm), are formed, with layer formation proceeding more quickly so that shorter gas times are required (less gas evolution, less loss of material and chemicals). A particularly suitable iron(III) source is iron(III) nitrate because of its particularly good solubility, its ready availability and its good accelerating effect.

When the component c) of the reactive lubricant in step 3 comprises at least one film former selected from the group consisting of homopolymers and copolymers of ethylene, propylene, styrene, (meth)acrylic acid, (meth)acrylate, vinylamine, vinylformamide, vinylpyrrolidone, vinylcaprolactam, vinyl acetate, vinylimidazole and/or epoxide and salts thereof and also polyurethanes, polyamides, polyethylenimines, polyamines and salts thereof, the total content of these film formers in the reactive lubricant is preferably in the range from 0.01 to 100 g/l, particularly preferably from 0.5 to 30 g/l and very particularly preferably from 1 to 20 g/l.

When the component c) comprises at least one wax selected from the group consisting of nonionic waxes and cationically stabilized waxes, the total content of these waxes in the reactive lubricant is preferably in the range from 0.1 to 300 g/l, particularly preferably from 0.1 to 150 g/l and very particularly preferably from 5 to 70 g/l.

When the component c) comprises at least one emulsified lubricating oil, the total content of emulsified lubricating oil is preferably in the range from 1 to 50% by weight, particularly preferably from 10 to 40% by weight and very particularly preferably from 20 to 30% by weight, calculated as pure oil and based on the total reactive lubricant.

In a first preferred embodiment, the component c) of the reactive lubricant in step 3 comprises at least one film former selected from the group consisting of homopolymers and copolymers of ethylene, propylene, styrene, (meth)acrylic acid, (meth)acrylate, vinylamine, vinylformamide, vinylpyrrolidone, vinylcaprolactam, vinyl acetate, vinylimidazole and/or epoxide and salts thereof and also polyurethanes, polyamides, polyethylenimines, polyamines and salts thereof. The presence of a film former as described above has the advantage that the resulting lubricating film is anchored on the substrate and thus has a greater hardness and stability. In addition, a more homogeneous layer is obtained.

In a first particularly preferred embodiment, the component c) comprises only at least one film former selected from the group consisting of homopolymers and copolymers of ethylene, propylene, (meth)acrylic acid, (meth)acrylate, vinylamine, vinylformamide, vinylpyrrolidone, vinylcaprolactam, vinyl acetate, vinylimidazole and/or epoxide and salts thereof and also polyethylenimines, polyamines and salts thereof, in particular consisting of homopolymers and copolymers of vinylpyrrolidone, but no other film former. The abovementioned film formers, in particular the homopolymers and copolymers of vinylpyrrolidone, have the advantage of being particularly acid-stable, which leads to the water-based, acidic, reactive lubricant in step 3 having a particularly low tendency to undergo phase separation and to undergo protonation and destabilization at the temperatures which normally occur in cold forming processes, even at a very low pH in the range from 0.15 to 1.5 and a high salt content, when only at least one of these film formers is comprised. The weight average molar mass of the at least one film former, in particular in the case of polyvinylpyrrolidone (for example obtainable as Sokalan® K 17P, BASF, Germany), is more preferably in the range from 1000 to 700,000 g/mol, particularly preferably from 3000 to 300,000 g/mol and very particularly preferably from 4000 to 47500 g/mol.

In a second particularly preferred embodiment, the component c) comprises at least one film former selected from the group consisting of polyethylene-polypropylene copolymers, polyethylene and polypropylene homopolymers, in particular polyethylene homopolymers, and vinylamine-vinylformamide copolymers. Vinylamine-vinylformamide copolymers, for example obtainable as Lupamin® 9030 (BASF, Germany), are very particularly useful here.

In a second preferred embodiment, the component c) of the reactive lubricant in step 3 comprises at least one wax selected from the group consisting of nonionic waxes and cationically stabilized waxes. The presence of a wax as described above has the advantage that it forms a lubricating film only in the molten state, i.e. during forming. Here, preference is given to nonionic waxes which are in each case stabilized by at least one nonionic surfactant in an acid medium, while cationically stabilized waxes which are in each case stabilized by at least one cationic surfactant in an acid medium are preferred. The reactive lubricant in step 3 therefore preferably contains at least one nonionic or cationic surfactant. This also applies to the following particularly preferred embodiments.

In a first particularly preferred embodiment, the component c) comprises only at least one wax selected from the group consisting of nonionic waxes and cationically stabilized waxes, in particular consisting of cationically stabilized waxes, but no other wax. The abovementioned waxes, in particular the cationically stabilized waxes, have the advantage of being particularly acid-stable, which leads to the water-based, acidic, reactive lubricant in step 3 having a particularly low tendency to undergo phase separation and to undergo protonation and destabilization at the temperatures which usually occur in cold forming processes, even at a very low pH in the range from 0.15 to 1.5 and a high salt content, when only at least one of these waxes is comprised. Aqueous dispersions of polypropylene waxes (e.g. Aquacer 1041, BYK, Germany) and/or Wükonil O-33A (Süddeutsche Emulsions-Chemie GmbH, Germany) and also montan waxes (e.g. Licowax KST. Clariant, Germany) are particularly useful here.

In a second particularly preferred embodiment, the component c) comprises at least one nonionic wax which is preferably selected from the group consisting of nonionic beeswaxes, nonionic polyethylene waxes, nonionic HDPE waxes and montan waxes and is particularly preferably selected from the group consisting of nonionic beeswaxes (e.g. Aquacer 561, BYK, Germany), nonionic polyethylene waxes and nonionic HDPE waxes (e.g. Aquacer 517, BYK, Germany). Here, "HDPE" is High Density Polyethylene, which, due to relatively unbranched polymer chains, has a high density, preferably in the range from 0.94 to 0.97 $g/cm^3$.

The at least one wax preferably comprises at least three, more preferably at least 5, waxes having different melting points. Due to the coverage of a larger melting point range of preferably at least 50° C., more preferably at least 65° C., resulting therefrom, the waxes melt and lubricate at different forming temperatures in each case, as a result of which the lubricating performance under different forming demands is optimized. In general, a high stress during forming leads namely to a higher temperature, while a low stress is accompanied by a lower temperature. In addition, locally different stresses and thus temperatures can also occur on a part to be formed.

In a third preferred embodiment, the component c) of the reactive lubricant in step 3 comprises at least one film former selected from the group consisting of homopolymers and copolymers of ethylene, propylene, styrene, (meth)acrylic acid, (meth)acrylate, vinylamine, vinylformamide, vinylpyrrolidone, vinylcaprolactam, vinyl acetate, vinylimidazole and/or epoxide and salts thereof and also polyurethanes, polyamides, polyethylenimines, polyamines and salts thereof, and also at least one wax selected from the group consisting of nonionic waxes and cationically stabilized waxes. Layers which are uniform and adhere very well and also lubricate optimally are obtained in this way. Here, preference is given to nonionic waxes which in each case are stabilized by at least one nonionic surfactant in an acid medium, while preference is given to cationically stabilized waxes which in each case are stabilized by at least one cationic surfactant in an acid medium. The reactive lubricant in step 3 therefore preferably comprises at least one nonionic or cationic surfactant. This also applies to the particularly preferred embodiments below.

In a first particularly preferred embodiment, the component c) comprises only at least one film former selected from the group consisting of homopolymers and copolymers of ethylene, propylene, (meth)acrylic acid, (meth)acrylate, vinylamine, vinylformamide, vinylpyrrolidone, vinylcaprolactam, vinyl acetate, vinylimidazole and/or epoxide and salts thereof and polyethylenimines, polyamines and salts thereof, in particular consisting of homopolymers and copolymers of vinylpyrrolidone, and also only at least one wax selected from the group consisting of nonionic waxes and cationically stabilized waxes, in particular consisting of cationically stabilized waxes, but no other film former and no other waxes. The abovementioned film formers and waxes have the advantage of being particularly acid-stable, which leads to the water-based, acidic, reactive lubricant in step 3 having a particularly low tendency to undergo phase separation and to undergo protonation and destabilization at the temperatures which usually occur in cold forming processes, even at a very low pH in the range from 0.15 to 1.5 and a high salt content, when only these film formers and waxes are comprised. The above-described combination of at least three, preferably at least five, waxes having different melting points has also been found to be advantageous here.

In a second particularly preferred embodiment, the component c) comprises at least one film former selected from the group consisting of polyethylene-polypropylene copolymers, polyethylene and polypropylene homopolymers, in particular polyethylene homopolymers, and vinylamine-vinylformamide copolymers, preferably from the group consisting of vinylamine-vinylformamide copolymers, and also at least one wax selected from the group consisting of nonionic beeswaxes, nonionic polyethylene waxes and nonionic HDPE waxes. The above-described combination of at least three, preferably at least five, waxes having different melting points has also been found to be advantageous here.

In a fourth preferred embodiment, the component c) of the reactive lubricant in step 3 comprises at least one emulsified lubricating oil.

The at least one emulsified lubricating oil is preferably selected from the group consisting of synthetic oils, mineral oils and vegetable oils, more preferably from among synthetic oils and mineral oils. One suitable mineral oil is, for example, Shell Gravex 913 (Shell, The Netherlands).

The at least one emulsified lubricating oil preferably has a viscosity in the range from 20 to 1000 mPas, in particular from 50 to 800 mPas and particularly preferably from 100 to 600 mPas. Viscosities in the abovementioned ranges are possessed by, for example, naphthenic-aliphatic base oils.

Particularly suitable emulsifiers for emulsifying the at least one lubricating oil are nonionic surfactants, more preferably fatty alcohol alkoxylates and very particularly preferably fatty alcohol ethoxylates such as ZOSOLAT 1008/85 (Chemetall, Germany). The total emulsifier content is preferably in the range 0.01 to 10% by weight, particularly preferably from 0.1 to 8% by weight and very particularly preferably from 1 to 5% by weight.

The reactive lubricant in step 3 of the process of the invention can comprise at least one thickener d), at least one antifoam e), at least one pigment f), at least one acid-stable surfactant g) and/or at least one corrosion inhibitor h) in addition to the components a), b) and c), which is advantageous in particular applications.

Particularly advantageous thickeners d) are thickeners based on polysaccharide, polysiloxane, polyvinylamide, i.e. polyacrylamide or polyethylene glycol. The total content of thickeners d) is preferably in the range up to 100 g/l, more preferably up to 10 g/l.

Particularly advantageous antifoams e) are polymer-based, silicone-free antifoams such as BYK-1711 (BYK, Germany) or antifoams based on 3D silicone such as Foam Ban MS-550 (Münzing, Germany). The total content of antifoams e) is preferably in the range up to 25 g/l, more preferably up to 10 g/l. The corrosive attack on the metallic substrate results in the evolution of gases which, particularly in the presence of at least one acid-stable surfactant g), can lead to a stable foam which deposits on the substrate, but this can be decreased or even prevented by use of an antifoam.

Particularly advantageous pigments f) are hexagonal boron nitride, graphite and molybdenum sulfide. These facilitate the cold forming process particularly effectively. The total content of pigments f) is preferably in the range up to 500 g/l, more preferably up to 50 g/l.

Particularly advantageous acid-stable surfactants g) are fatty alcohol alkoxylates and very particularly preferably fatty alcohol ethoxylates such as ZOSOLAT 1008/85 (Chemetall, Germany). The total content of acid-stable surfactants g) is preferably in the range from 0.01 to 10% by weight, particularly preferably from 0.1 to 8% by weight and very particularly preferably from 1 to 5% by weight.

The presence of an emulsified lubricating oil in combination with a corrosion inhibitor has the advantage that the corrosion resistance of the metallic substrate is significantly increased, as a result of which the correspondingly formed part can be stored for longer.

Particularly advantageous corrosion inhibitors h) are nonylphenoxyacetic acid (Irgacor® NPA, BASF, Germany), succinic acid monoesters (Irgacor® L 12, BASF, Germany) and imidazoline derivatives (Amine O, BASF, Germany). The total content of corrosion inhibitors h) is preferably in the range up to 10% by weight, more preferably in the range from 0.1 to 5% by weight, particularly preferably from 0.1 to 3% by weight.

The pH of the reactive lubricant in step 3 is preferably less than 2.0, more preferably in the range from 0.15 to 1.5. This has the advantage that the corrosive attack and thus layer formation is increased. On contacting with the metallic substrate, the temperature of the reactive lubricant is preferably in the range from 60 to 95° C., particularly preferably from 75 to 90° C. and very particularly preferably from 80 to 85° C.

If a temperature is selected in the abovementioned ranges, especially in the very particularly preferred range, combined conversion and lubricant layers which are particularly homogeneous and have excellent adhesion are obtained.

The reactive lubricant used in step 3 has been found to be particularly stable to heat. Thus, the lubricant remains homogeneous, i.e. agglomeration and precipitation of the c) at least one film former, at least one wax and/or at least one emulsified lubricating oil does not occur, even after a number of hours or even days at a temperature of 85° C.

The contacting of the metallic substrate with the reactive lubricant is preferably effected by dipping the substrate into the lubricant or by pouring the lubricant over the substrate. The contact time, i.e. treatment time, is preferably in the range from 1 to 40 minutes, particularly preferably from 5 to 30 minutes and very particularly preferably from 8 to 20 minutes.

Any sludges formed in the dipping bath can, as in the case of a phosphating bath, be removed by simple filtration with recovery of the bath.

It is advantageous for no phosphate layer to be deposited on the metallic substrate as a result of contacting of the metallic substrate with the reactive lubricant in step 3, since in the case of a subsequent heat treatment of correspondingly sensitive components, for example hardening and tempering of screws, phosphorus-induced formation of delta-ferrite occurs and this can have an adverse effect on the materials properties. The reactive lubricant is therefore preferably essentially phosphate-free, i.e. no phosphate is added thereto.

After step 3 of the process of the invention, the metallic substrate should not be rinsed since otherwise there is a risk of washing off the at least one film former, the at least one wax and/or the at least one emulsified lubricating oil which has or have been applied in step 3.

Finally, the metallic substrate can be dried in an optional step 4 before it is subjected to a cold forming process. In general, drying can be necessary in the case of water-based lubricants in order to avoid water-based residues when the treated bodies to be formed, e.g. wire bundles, are tightly packed. Here, a person skilled in the art will refer to "forced drying". In step 4, drying is preferably carried out by means of hot air at from 100 to 280° C., which leads to more rapid and more uniform drying of the lubricant layer and minimization of water residues. In step 4, drying means drying with assistance of an auxiliary such as hot air or an oven rather than drying of the metallic substrate, which may still be hot/warm from step 3, in air.

The process of the invention is in principle suitable for all possible cold forming processes, in particular for

- drawing (tensile forming), e.g. of welded or seamless tubes, hollow profiles, solid profiles, wires or rods, e.g. in wire drawing or tube drawing,
- spinning,
- ironing (forming to final dimensions) and/or deep drawing, e.g. of strips or sheets to give specifically deep-drawn shaped bodies or of hollow bodies to give more greatly deformed hollow bodies,
- thread rolling and/or thread striking, e.g. for nut or bolt blanks,
- pressing such as cold flow molding (pressure forming), e.g. of hollow bodies, solid bodies,
- extrusion and
- cold upset forging, e.g. of wire sections to form connecting elements such as nut or bolt blanks.

After forming, the metallic substrates which have been treated by the process of the invention can be cleaned readily, i.e. the combined conversion and lubricant layers can be removed by means of alkaline cleaners, acids or pickles, as are also used in the case of phosphating with an overlying polymer lubricant.

The present invention also provides a water-based, acidic, reactive lubricant for cold forming of metallic substrates, which comprises a) oxalic acid, b) at least one accelerator which comprises nitroguanidine and/or at least one iron(III) source and c) at least one film former, at least one wax and/or at least one emulsified lubricating oil, where the at least one film former is selected from the group consisting of homopolymers and copolymers of ethylene, propylene, styrene, (meth)acrylic acid, (meth)acrylate, vinylamine, vinylformamide, vinylpyrrolidone, vinylcaprolactam, vinyl acetate, vinylimidazole and/or epoxide and salts thereof and also polyurethanes, polyamides, polyethyleneimines, polyamines and salts thereof, where the at least one wax is selected from the group consisting of nonionic waxes and cationically stabilized waxes and where the at least one emulsified lubricating oil is selected from the group consisting of synthetic oils, mineral oils, vegetable oils and animal oils.

The advantageous embodiments of this reactive lubricant according to the invention have already been set forth above for the process of the invention.

The present invention also relates to a concentrate from which the reactive lubricant of the invention can be obtained by dilution, in particular with water, and optionally setting of the pH by means of a pH-modifying substance.

In addition, the present invention relates to a pretreated metallic substrate which is obtainable by the above-described process according to the invention.

The metallic substrate which can be obtained in this way has a combined conversion and lubricant layer having a layer weight determined by the method of gravimetric detachment in the range from 0.3 to 15 g/m$^2$, preferably from 0.3 to 10 g/m$^2$, calculated as lubricant layer, and in the range from 0.3 to 30 g/m$^2$, preferably from 1.5 to 15 g/m$^2$, calculated as separation/conversion layer.

It has in the present studies surprisingly been found that the combined layer can be adjusted separately and individually. Thus, a longer treatment time in step 3 of the process of the invention gives a thicker separation/conversion layer, i.e. a higher layer weight calculated as separation/conversion layer, while a higher concentration of film former/wax/emulsified lubricating oil, i.e. the component c) of the reactive lubricant of the invention, leads to a thicker lubricant layer, i.e. a higher layer weight calculated as lubricant layer. In this way, a combined conversion and lubricant layer tailored to the respective conditions of the cold forming operation can be produced.

As a result of the high layer weight obtained and the physicochemical adhesion, the combined conversion and lubricant layers "survive" conventional cold forming processes. Thus, at least 10%, preferably at least 15%, particularly preferably at least 20% and very particularly preferably at least 23%, of the total layer weight (calculated as lubricant layer and calculated as separation/conversion layer taken together) remain on a pretreated and predrawn high carbon wire when this wire has been subjected to a forming simulation on the drawing bench in a single operation which comprises a total reduction in the diameter of at least 40%, preferably at least 50% and particularly preferably at least 55%, in four steps. Here, the total reduction in % is calculated as [(initial diameter: final diameter)−1]×100. Temporarily satisfactory corrosion protection of the formed substrate can be achieved in this way.

Finally, the present invention provides for the use of a pretreated metallic substrate obtainable by the process of the invention in a cold forming process, for example for the production of tubes, wires, connecting elements, profiles, sealing parts or gearbox parts.

The present invention will be illustrated below by working examples, which are not to be construed as constituting a restriction, and comparative examples.

EXAMPLES

The acidic reactive lubricants A to I which comprise the constituents listed in Tab. 1 together with water were made up.

TABLE 1

| values in % by weight | A | B | C | D | E | F | G | H | I |
|---|---|---|---|---|---|---|---|---|---|
| Lubricating oil | — | — | — | — | — | — | 25 | 25 | 25 |
| nonionic PE wax | 4.0 | 2.8 | 2.8 | 2.8 | 2.8 | — | — | — | — |

TABLE 1-continued

| values in % by weight | A | B | C | D | E | F | G | H | I |
|---|---|---|---|---|---|---|---|---|---|
| nonionic HDPE wax | — | — | — | 0.7 | 0.7 | — | — | — | — |
| nonionic canauba wax | — | — | — | 0.3 | 0.3 | — | — | — | — |
| nonionic beeswax | 0.5 | 0.5 | 0.5 | 0.4 | 0.4 | — | — | — | — |
| cationically stabilized PP wax | — | — | — | — | — | 3 | — | — | — |
| Wax compound in Wükonil O-33A | — | — | — | — | — | 0.9 | — | — | — |
| Montan wax | — | — | — | — | — | 0.7 | — | — | — |
| nonionic/anionic PE primary dispersion | 2.4 | 1.6 | 1.6 | 0.7 | 0.7 | — | — | — | — |
| vinylamine-vinyl-formamide copolymer | 0.48 | 0.16 | 0.16 | 0.16 | 0.16 | — | — | — | — |
| Polyvinylpyrrolidone | — | — | — | — | — | 0.9 | — | — | — |
| oxalic acid dihydrate | 1.5 | 1.5 | 1.5 | 1.5 | 1.5 | 3.0 | 1.5 | 1.5 | 1.5 |
| Nitroguanidine | 0.125 | 0.125 | — | 0.125 | — | — | 0.125 | 0.125 | 0.125 |
| Iron(III) nitrate | — | — | 0.06 | — | 0.06 | 0.06 | — | — | — |
| pH | 1.1 | 0.9 | 0.9 | 1.0 | 0.9 | 0.9 | n.d.* | n.d.* | n.d.* |
| polymer-based, silicone-free anti-foam | — | 0.25 | 0.25 | 0.25 | 0.25 | — | — | — | — |
| 3D silicone anti-foam | — | — | — | — | — | 0.15 | — | — | — |
| Fatty alcohol with 8 mol of ethylene oxide | — | — | — | — | — | — | 2 | 2 | 2 |
| Nonylphenoxyacetic acid | — | — | — | — | — | — | 0.025 | — | — |
| Succinic acid monoester | — | — | — | — | — | — | — | 0.025 | — |
| Imidazonline derivative | — | — | — | — | — | — | — | — | 0.025 |

*not determined

The reactive lubricants A to E were each heated while stirring to different temperatures and maintained at the corresponding temperature for a number of hours. Up to a temperature of 85° C., the lubricants remained homogeneous, i.e. no agglomeration and precipitation of the waxes and film formers comprised occurred. This was not the case for lubricant D after more than 14 hours and in the case of lubricant E even after more than 5 days. However, the lubricant F was found to be extraordinarily thermally stable. In this case, agglomeration and precipitation did not occur even at a temperature of 95° C. after more than 5 days.

Various steel substrates were each dipped into the reactive lubricants for from 8 to 10 minutes at from 80 to 85° C. Foam development was able to be reduced significantly by addition of the antifoam (lubricants B to F compared to lubricants A and G to I). The layer weights of the deposited layers were, after drying of the warm substrate in air, determined by means of gravimetric detachment for the lubricants B and E to I.

The method of gravimetric detachment is carried out as follows:

1) The surface area of the pretreated metallic substrate is calculated and the latter is weighed.

2) The lubricant layer is removed in the solvent xylene.

3) The metallic substrate is weighed again.

4) The separation/conversion layer is removed in 10-20% strength sodium hydroxide solution comprising triethylamine/EDTA.

5) The metallic substrate is weighed again.

The weight difference between 1) and 3) divided by the surface area gives the layer weight calculated as lubricant layer, while the weight difference between 3) and 5) divided by the surface area is the layer weight calculated as separation/conversion layer.

Tab. 2 and tab. 3 show the layer weights determined in this way calculated as lubricant layer (SG(S)) and calculated as separation/conversion layer (SG(K)), in each case in g/m$^2$ and as average values of n=3 (n.d.=not determined).

TABLE 2

| Lubricant/ | CRS | | Slug | | Wire | | Wire bundle | |
|---|---|---|---|---|---|---|---|---|
| Substrate | SG(S) | SG(K) | SG(S) | SG(K) | SG(S) | SG(K) | SG(S) | SG(K) |
| B | 2.1 | 7.2 | 4.9 | 9.8 | 3.3 | 7.4 | n.d. | n.d. |
| E | n.d. | n.d. | n.d. | n.d. | n.d. | n.d. | 0.6 | 12.3 |

TABLE 3

| Lubricant/ | CRS* | | HRS** | |
|---|---|---|---|---|
| Substrate | SG(S) | SG(K) | SG(S) | SG(K) |
| F | 3.5 | 4.3 | 6.9 | 7.7 |
| G | 8 | 5 | 8 | 6 |
| H | 6 | 6 | 7 | 6 |
| I | 8 | 2 | 7 | 3 |

*cold-rolled steel sheet;
**hot-rolled steel sheet

In all cases, the deposition of a combined conversion and lubricant layer could be confirmed in this way. Scanning electron micrographs of the surface of the wire bundle pretreated with lubricant E additionally showed a homogeneous, closed layer composed of oxalate crystals.

All combined conversion and lubricant layers adhered firmly to the substrate surface and ensured good temporary corrosion protection.

A high-carbon wire of the grade ST1375/1570 (Voestalpine, Austria), was pretreated with the reactive lubricant E as described above. The diameter of the wire was then reduced in four steps from 10.9 mm to 7.0 mm on a drawing bench (see Tab. 4). Three different drawing speeds were used here: 20 m/s, 40 m/s and 60 m/s. At all drawing speeds, forming proceeded successfully. No defects such as scratches on the drawn wire occurred. The measured tensile force was in each case comparable to conventional polymer lubricants. The surface temperatures arising were below 110° C.

TABLE 4

| Forming stage | Diameter in mm previously | afterwards | Reduction in % |
|---|---|---|---|
| 1 | 10.9 | 9.8 | 19.2 |
| 2 | 9.8 | 8.8 | 19.4 |
| 3 | 8.8 | 7.9 | 19.4 |
| 4 | 7.9 | 7.0 | 21.5 |
| | Total reduction | | 58.8 |

The layer weights in g/m$^2$ were determined by means of gravimetric detachment as described above before and after the entire forming operation. The results obtained are shown in Tab. 5 (average values of n=4).

TABLE 5

| Forming | SG(S) | SG(K) |
|---|---|---|
| previously | 3.2 | 11.4 |
| afterwards | 0.4 | 3.0 |

Before forming, the total layer weight was thus about 15 g/m$^2$, of which still about 3.5 g/m$^2$ remained after forming. That is to say, about 25% of the layer remained.

Accordingly, although it was observed during the last forming stage that the combined conversion and lubricant layer became visibly thin, no visible exposure of the substrate surface occurred.

A high-carbon wire of the grade ST1375/1570 (Voestalpine, Austria), was pretreated with the reactive lubricant F as described above. The diameter of the wire was then reduced from 11 to 6.7 mm in four steps (Exp. I and Exp. II) or from 11 to 7.4 mm in two steps (Exp. III) on a drawing bench (see Tab. 6). Three different drawing speeds were used here, namely 30 m/s (Exp. I), 60 m/s (Exp. II) and 40 m/s (Exp. III), with the diameter of the wire being reduced by 20% (Exp. I and Exp. II) or 35% per forming stage. Forming proceeded successfully in all cases. No defects such as scratches on the drawn wire occurred. The measured tensile force was in each case comparable to conventional polymer lubricants. The surface temperatures arising were below 110° C.

TABLE 6

| Forming | Exp. I and II | | Exp. III | |
|---|---|---|---|---|
| | Diameter in mm | | | |
| stage | previously | afterwards | previously | afterwards |
| 1 | 11 | 9.8 | 11 | 8.5 |
| 2 | 9.8 | 8.8 | 8.5 | 7.4 |
| 3 | 8.8 | 7.8 | — | — |
| 4 | 7.8 | 6.7 | — | — |

The layer weights in g/m$^2$ were determined by means of gravimetric detachment as described above after the entire forming operation. The results obtained are summarized in Tab. 7 (SG(G)=total layer weight).

TABLE 7

| Exp. | SG(S) | SG(K) | SG(G) |
|---|---|---|---|
| I | 3.2 | 3.8 | 7.0 |
| II. | 3.4 | 5.2 | 8.6 |
| III | 2.7 | 3.6 | 6.3 |

In each case, a combined conversion and lubricant layer thus remained on the substrate in such a thickness that further forming stages, i.e. diameter reductions, could have been carried out.

The invention claimed is:

1. A process for a pretreatment of a metallic substrate for cold forming, wherein the metallic substrate is successively
1) optionally mechanically or chemically cleaned and subsequently rinsed,
2) optionally pickled and subsequently rinsed,
3) brought into contact with a water-based, acidic, reactive lubricant comprising
a) oxalic acid,
b) at least one accelerator which comprises nitroguanidine and/or at least one iron(III) source, and
c) at least one emulsified lubricating oil, and optionally at least one film former and/or at least one wax, and
4) optionally dried,
wherein the at least one film former is selected from the group consisting of homopolymers and copolymers of ethylene, propylene, styrene, (meth)acrylic acid, (meth) acrylate, vinylamine, vinylformamide, vinylpyrrolidone, vinylcaprolactam, vinyl acetate, vinylimidazole and/or epoxide and salts thereof, and polyurethanes, polyamides, polyethyleneimines, polyamines and salts thereof,
wherein the at least one wax is selected from the group consisting of nonionic waxes and cationically stabilized waxes,
wherein the at least one emulsified lubricating oil is selected from the group consisting of synthetic oils, mineral oils, vegetable oils and animal oils, and
wherein a pH of the reactive lubricant is less than 2.0.

2. The process according to claim 1, wherein the component c) of the reactive lubricant comprises at least one film former, selected from the group consisting of homopolymers and copolymers of ethylene, propylene, (meth)acrylic acid, (meth)acrylate, vinylamine, vinylformamide, vinylpyrrolidone, vinylcaprolactam, vinyl acetate, vinylimidazole and/or epoxide and salts thereof, and polyethylenimines, polyamines and salts thereof.

3. The process according to claim 1, wherein the component c) of the reactive lubricant comprises at least one wax selected from the group consisting of nonionic waxes and cationically stabilized waxes.

4. The process according to claim 3, wherein the at least one wax comprises at least three, waxes having different melting points.

5. The process according to claim 1, wherein the reactive lubricant comprises at least one antifoam e).

6. The process according to claim 1, wherein the reactive lubricant comprises at least one acid-stable surfactant g).

7. The process according to claim 1, wherein the reactive lubricant comprises at least one corrosion inhibitor h).

8. The process according to claim 1, wherein a temperature of the reactive lubricant is in a range from 60 to 90° C.

9. A water-based, acidic, reactive lubricant for cold forming of metallic substrates, wherein the reactive lubricant comprises a) oxalic acid, b) at least one accelerator which comprises nitroguanidine and/or at least one iron(III) source, and c) at least one emulsified lubricating oil, and optionally at least one film former and/or at least one wax, wherein the at least one film former is selected from the group consisting of homopolymers and copolymers of ethylene, propylene, styrene, (meth)acrylic acid, (meth) acrylate, vinylamine, vinylformamide, vinylpyrrolidone, vinylcaprolactam, vinyl acetate, vinylimidazole and/or epoxide and salts thereof, and polyurethanes, polyamides, polyethyleneimines, polyamines and salts thereof, wherein the at least one wax is selected from the group consisting of nonionic waxes and cationically stabilized waxes, wherein the at least one emulsified lubricating oil is selected from the group consisting of synthetic oils, mineral oils, vegetable oils and animal oils, and wherein a pH of the reactive lubricant is less than 2.0.

10. A concentrate from which the reactive lubricant according to claim 9 can be obtained by dilution, and optionally setting of a pH by means of a pH-modifying substance.

11. A pretreated metallic substrate comprising a combined conversion and lubricant layer and obtained by a process according to claim 1.

12. The metallic substrate according to claim 11, wherein the layer weight of the combined conversion and lubricant layer determined by a method of gravimetric detachment is in a range from 0.3 to 15 g/m2, calculated as lubricant layer, and in a range from 0.3 to 30 g/m2, calculated as separation/conversion layer.

13. A method of using the metallic substrate according to claim 11, the method comprising using the metallic substrate in a cold forming process.

14. The process according to claim 1, wherein the component c) of the reactive lubricant comprises only one film former selected from the group consisting of homopolymers and copolymers of ethylene, propylene, (meth)acrylic acid, (meth)acrylate, vinylamine, vinylformamide, vinylpyrrolidone, vinylcaprolactam, vinyl acetate, vinylimidazole and/or epoxide and salts thereof, and polyethylenimines, polyamines and salts thereof.

15. The process according to claim 1, wherein the component c) of the reactive lubricant comprises only one film former selected from the group consisting of homopolymers and copolymers of vinylpyrrolidone, but no other film former.

16. The process according to claim 1, wherein the component c) of the reactive lubricant comprises only one wax selected from the group consisting of nonionic waxes and cationically stabilized waxes.

17. The process according to claim 1, wherein the component c) of the reactive lubricant comprises only one wax selected from the group consisting of cationically stabilized waxes, but no other wax.

18. The process according to claim 3, wherein the at least one wax comprises at least five waxes having different melting points.

* * * * *